US007488909B2

(12) United States Patent
Kajiwara et al.

(10) Patent No.: US 7,488,909 B2
(45) Date of Patent: Feb. 10, 2009

(54) LIGHTED SWITCH APPARATUS

(75) Inventors: Fumito Kajiwara, Miyagi-ken (JP); Kim Dohyung, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 252 days.

(21) Appl. No.: 11/274,879

(22) Filed: Nov. 2, 2005

(65) Prior Publication Data

US 2006/0102456 A1 May 18, 2006

(30) Foreign Application Priority Data

Nov. 15, 2004 (JP) ..... 2004-330697

(51) Int. Cl.
*H01H 9/00* (2006.01)

(52) U.S. Cl. ..... 200/310; 200/315

(58) Field of Classification Search ..... 200/310
See application file for complete search history.

(56) References Cited

U.S. PATENT DOCUMENTS 5,813,519 A 9/1998 Gotoh
5,826,708 A * 10/1998 Finlay ..... 200/314
5,850,062 A * 12/1998 Botz et al. ..... 200/315
5,878,870 A * 3/1999 Ohtaki ..... 200/314
6,928,297 B2 * 8/2005 Kitamura et al. ..... 455/550.1

FOREIGN PATENT DOCUMENTS

JP 2004-199005 7/2004

* cited by examiner

*Primary Examiner*—Elvin G Enad
*Assistant Examiner*—Lheiren Mae A Anglo
(74) *Attorney, Agent, or Firm*—Brinks Hofer Gilson & Lione

(57) ABSTRACT

A lighted switch apparatus includes a casing (upper case) that has an opening; an operating part that is movable and has at least a pair of indicators; and a light source that is disposed in the casing (the upper case and a lower case). In this case, the operating knob includes a shaft portion (light-guiding member) composed of a light-guiding member having one end, which is inserted into the opening of the casing to be positioned in the casing and is disposed to face the light source, a knob light guiding part (operating part) having reflecting portions that are provided below the indicators of the operating part and reflects light from the other end of the shaft portion positioned outside of the casing to the indicators, and second reflecting portions that reflect and lead the light from the other end of the shaft portion to the knob light guiding part.

5 Claims, 7 Drawing Sheets

LIGHTED SWITCH APPARATUS

BACKGROUND OF THE INVENTION

1. Field of the Invention

The present invention relates to a switch apparatus for switching a device between ON and OFF states or between functions and, more particularly, to a lighted switch apparatus in which the position or switching state of an operating knob is indicated by a light source provided in the switch apparatus.

2. Description of the Related Art

Conventionally, the mirror switch apparatus has been provided as an example of the lighted switch apparatus, which switches a device between ON and OFF states or between functions and in which the position or switching state of an operating knob is indicated by a light source provided in the switch apparatus. The mirror switch apparatus is used to remotely operate the angles of the left and right mirrors on the vehicle body from the driver's seat by the driving power of the motor.

The mirror switch apparatus has a change-over switch and an angle adjustor switch, both of which are provided in one housing. The change-over switch is used for switching to the left mirror or to the right mirror. The angle adjustor switch has one knob, which can be tilted in any direction for adjusting the tilting angle of the switched mirror in the vertical or horizontal directions.

Such a switch apparatus mounted in a vehicle may be operated in the evening or at night when it is dark out. Accordingly, in dark places, a lighted switch apparatus incorporating an illuminating device is used to permit the driver to know the position and switching state of the switch apparatus. When two switches are built close to each other as in the above-described mirror switch apparatus, there is, in particular, a demand for an illuminating device that easily allows the operator to know the current position of the change-over switch or the vertical or horizontal operating positions even in dark places.

An example of a lighted switch apparatus in the related art is disclosed in JP-A-9-245567 (U.S. Pat. No. 5,813,519), and is shown in FIGS. 7 to 9.

The mirror switch apparatus, in particular, the left and right mirror switch apparatus shown in FIGS. 7 to 9 primarily includes an upper case 201 with an open bottom, an operating knob 202 for selectively controlling left and right mirror driving motors (not shown), a light-guiding member 203 for guiding light to the operating knob 202, a circuit board 204 having, for example, a pattern of a plurality of stationary contacts printed thereon, and a lower case 205 which is a cover for securing the light-guiding member 203 and the circuit board 204 along with the upper case 201.

The upper case 201 has an opening 201*a* formed in its top surface for inserting therein the bottom of the operating knob 202 of a slide switch portion, a pair of light-intercepting portions 201*b* formed on both sides of the opening 201*a* so as to extend in the sliding direction of the operating knob 202, and side faces 201*c* formed from each of the side edges of the top surface. A pair of engaging recesses 201*d* are provided with a predetermined interval at the bottom of each of opposing side surface 201*c* on one side of the side surface 201*c* of the upper case 201.

The operating knob 202 is disposed above the top surface of the upper case 201 and is slidably fitted into the opening 201*a* of the upper case 201 in the longitudinal direction. The center of top face of the operating knob 202 is formed as a knob portion 202*a* which the operator moves with his fingers when operating the knob. Transparent indicators 202*b*, molded from two components, are formed on both sides of the knob portion 202*a* in the sliding direction in the form of arrows, characters, and symbols indicating directions. A square-shaped cylindrical connector is projected in the center of the lower surface of the operating knob 202, and engaging recesses 202*c* are formed at the opposing walls of the connector.

A slider member 206, integrally formed with the operating knob 202, is slidably accommodated in the upper case 201. The operating knob 202 and the slider member 206 form the slider. The slider member 206 is made of transparent synthetic resin and has a connector 206*a* projecting from the center of the top surface of the slider member 206. The connector 206*a* of the slider member 206 is inserted into the opening 201*a* of the upper case 201 and fitted to the connector of the operating knob 202. An engaging protrusion 206*b* of the connector 206*a* of the slider member 206 engages the engaging recesses 202*c* of the operating knob 202, whereby the operating knob 202 and the slider member 206 are snap-fitted with each other. Gaps are formed between the bottoms of the indicators 202*b* of the operating knob 202 and the slider member 206 for placing the light-intercepting portions 201*b* of the upper case 201 therein. Accordingly, when the operating knob 202 is moved in a reciprocating fashion along the opening 201*a* from above the upper case 201, the slider member 206 also reciprocates in the same direction. The length of the slider member 206 in the direction of movement is such that when the slider member 206 is moved in one direction and the connector 206*a* engages one end of the connector 206*a*, the portion on the other side of the connector 206*a* located on the starting end of the sliding movement is located below the opening 201*a*. In addition, as shown in FIG. 9, two rectangular recesses 206*c* are formed in a side face extending in a direction perpendicular to the direction of movement of the slider member 206, with the recesses 206*c* formed substantially horizontally and being separated by a distance equal to the thick-walled portion of the knob portion 202*a*. The ends of the two recesses 206*c* incline upward from the bottom to the top, so that light, coming from a side face opposing the side face in which the openings of the recesses 206*c* are formed, is reflected upward by inclined reflecting surfaces 206*d*. Spaced movable contact accommodating recesses 206*e* are formed at both ends of the lower face of the slider member 206, and accommodate flat movable contacts (not shown), respectively. In the slider member 206, a ball operates to elastically press-contact against the side face 201*c* of the upper case 201 by the ball and a spring (not shown) in order to retain the operating knob 202 in the two switching positions and the neutral position so as to cause the operator to feel a click.

As shown in FIG. 9, the light-guiding member 203 is made of transparent synthetic resin and includes a light-incoming portion 203*a* positioned at the center of the supporting base of the upper case 201, and a light-guiding portion 203*b* which extends from one side of the light-incoming portion 203*a* and has one side disposed in the vicinity of and in opposing relationship to the side face which opposes the side face in which the openings of the recesses 206*c* of the slider member 206 are located. An opening 203*c* is formed so as to pass vertically through the center of the light-incoming portion 203*a*. A lighting lamp (not shown) is inserted into the opening 203*c*. The lighting lamp is fixed to the protrusion (not shown) which is formed to pass through a hole (not shown) formed on the circuit board 204 of the lower case 205, and protrudes from the hole of the circuit board 204.

Next, the illuminating state of the operating knob 202 of the mirror switch apparatus having such a construction in the case where the lighting lamp is lit will be described.

As shown in FIG. 7, when the operating knob 202 protruding from the top of the upper case 201 is in the neutral position, the slider member 206 is also positioned in the neutral position. The connector 206*a* is also positioned roughly in the central portion of the opening 201*a*. Accordingly, in the indicators 202*b* positioned on both sides of the knob portion 202*a*, the light from the lighting lamp passes through the light-guiding portion 203*b* from the light-incoming portion 203*a* of the light-guiding member 203, and illuminates the side face of the slider member 206 from the end of the light-guiding portion 203*b*. The light is reflected upward by the two reflecting surfaces 206*d* of the slider member 206, and illuminates the both of the indicators 202*b* from the opening 201*a*. Since both of the indicators 202*b* are bright in the neutral position, the driver can easily recognize that the operating knob 202 of the mirror switch apparatus is in the neutral position.

As shown in FIG. 8, when the operating knob 202 in the neutral position is moved toward the right, the movable contacts, accommodated in the right movable contact accommodating recess 206*e*, comes into contact with, for example, the right stationary contact of the two stationary contacts on the circuit board 204, whereby the right mirror driving motor is ready to be driven. At this time, as shown in FIG. 8, the right light-intercepting portion 201*b*, disposed below the right indicator 202*b*, comes between the operation knob 202 and the slider member 206 to shield the light path from light, causing the right indicator 202*b* of the operating knob 202 to become dark. On the other hand, since the left indicator 202*b* moves away from the left light-intercepting portion 201*b* and arrives above the opening 201*a*, light from the lighting lamp reflected by the left reflecting surface 206*d* of the slider member 206 reaches the left indicator 202*b* of the operating knob 202 to illuminate the left indicator 202*b*. Further, R indicating the right is formed on the left indicator 202*b*, and L indicating the left is formed on the right indicator.

The lighted switch apparatus according to the related art is configured so that the reflecting surface 206*d* of the slider member 206 is provided below the opening 201*a* the upper case 201, and light is led to the indicator 202*b* of the operation knob 202. Accordingly, there is a problem that the light leaks from the opening 201*a* by the operating the slider member 206. In addition, when the slider member 206 is positioned on both sides of moving path, the indicators 202*b* needs to form the opening 201*a* so as to face the reflecting surface 206*d* and area of the reflecting surface 206*d* needs to be set in consideration of the indicators 202*b*. For example, when the indicators 202*b* is set to be large, it is necessary to change the reflecting surface 206*d* and the opening 201*a* to be large, and to change the length of the light-intercepting portions 201*b* to be long. Accordingly, there is a problem that the manufacturing cost increases. Furthermore, for example, if the opening 201*a* does not need to be illuminated, even though the open opening 201*a* is formed in the size allowing the movement of the slider 206, there has been no problem. However, in case of the illuminating structure, it is necessary to make the space where at least two indicators 202*b* are formed. Consequently, there are times when the opening 201*a* is set to be large for the illuminating structure, and there is a problem that restriction of the structure to close the opening 201*a* becomes large.

In addition, both of the indicators 202*b* are illuminated in the neutral position of the operating knob 202, and one of the indicators 202*b* is illuminated in the distal position in which the operating knob 202 is move to the right or left side. For example, when both of the indicators 202*b* are illuminated in the distal position, it is conceivable that the light-intercepting portions 201*b* are removed. However, in this case, the opening 201*a* again becomes large and a part of the inside is seen from above to be an exposed state. Furthermore, since the side face (light outgoing face) of the light-guiding member 203 facing the slider member 206 is deviated, there is a problem that sufficient illumination intensity cannot be obtained. Moreover, since the illumination intensity of the indicators 202*b* is changed by the position of the operating knob 202, there is a problem that the operating knob does not look good.

SUMMARY OF THE INVENTION

The invention has been made to solve the above-mentioned problems, and it is an object of the invention to provide a lighted switch apparatus. In the lighted switch apparatus, even though the operating part is operated, the lighted switch apparatus can always illuminate indicators and the opening is small. Therefore, even though the operating knob is moved, the opening is closed and possibility of penetration of the foreign material can be decreased.

In order to achieve the above-mentioned object, a lighted switch apparatus according to the invention includes a casing that has an opening, an operating knob that is movable and has at least a pair of indicators, and a light source that is disposed in the casing. In this case, the operating knob includes a shaft portion composed of a light-guiding member having one end, which is inserted into the opening of the casing to be positioned in the casing and is disposed to face the light source, a knob light guiding part having reflecting portions that are provided below the indicators of the operating knob and reflects light from the other end of the shaft portion positioned outside of the casing to the indicators, and second reflecting portions that reflect and lead the light from the other end of the shaft portion to the knob light guiding part.

Further, in the above-mentioned lighted switch apparatus, it is preferable that the light source be supported on the operating knob to be integrally moved.

Furthermore, in the above-mentioned lighted switch apparatus, it is preferable that the light-shielding portions be formed on the operating knob by two-color molding.

Moreover, in the above-mentioned lighted switch apparatus, it is preferable that the light-shielding portions be formed on a surface of the knob light guiding part, and each of the light-shielding portions be provided with a tapered portion and an extending portion, which is connected to the tapered portion and extends in the direction away from the central portion.

In addition, in the above-mentioned lighted switch apparatus, it is preferable that the shaft portion of the light-guiding member and the knob light guiding part be separately formed, and the second reflecting portions be provided on the shaft portion.

DESCRIPTION OF THE PREFERRED EMBODIMENTS

Hereinafter, an embodiment of a lighted switch apparatus according to the invention will be described with reference to the drawings.

Figure 1:
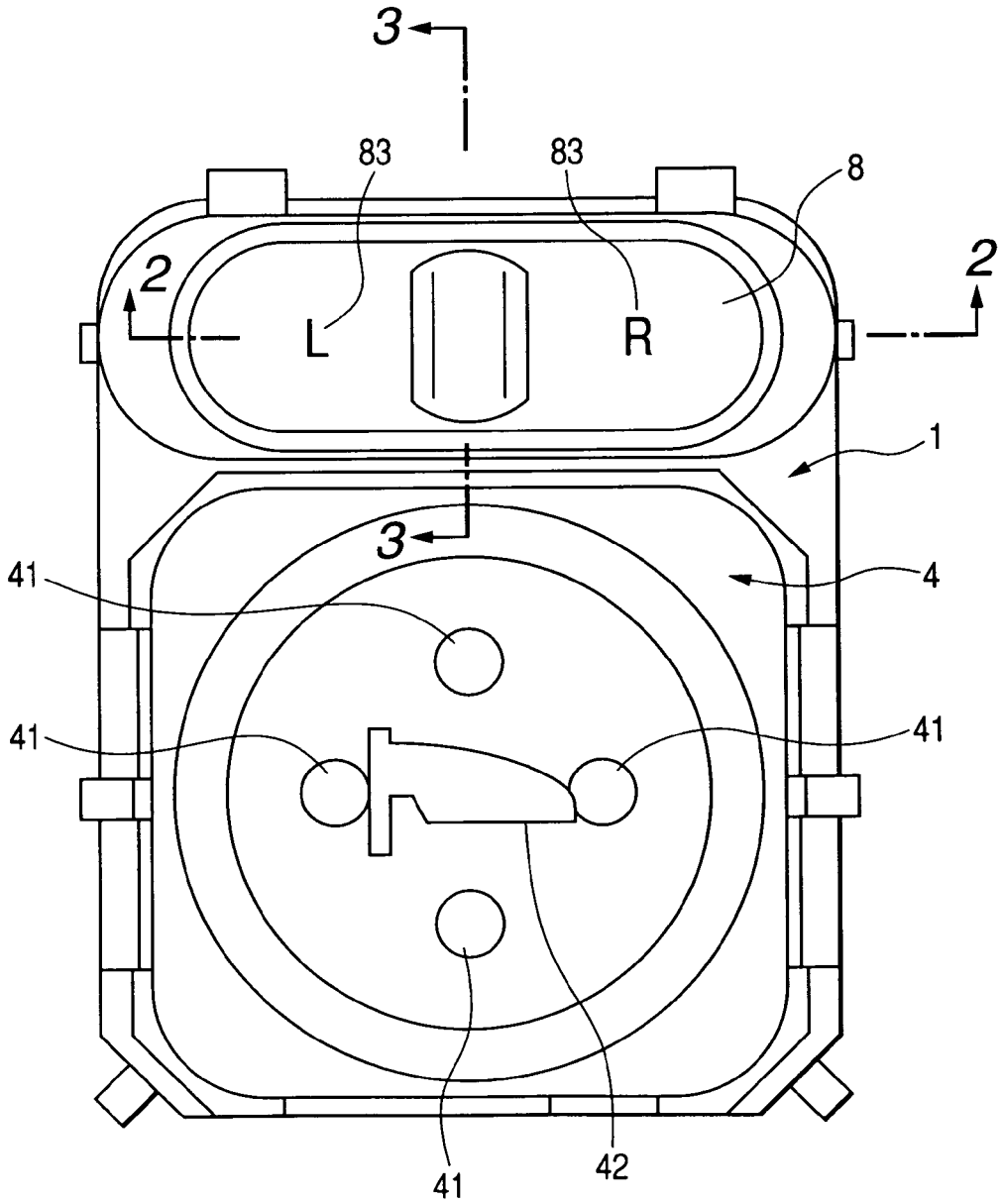
FIG. 1 is a plan view showing a lighted switch apparatus according to an embodiment of the invention.
Figure 2:
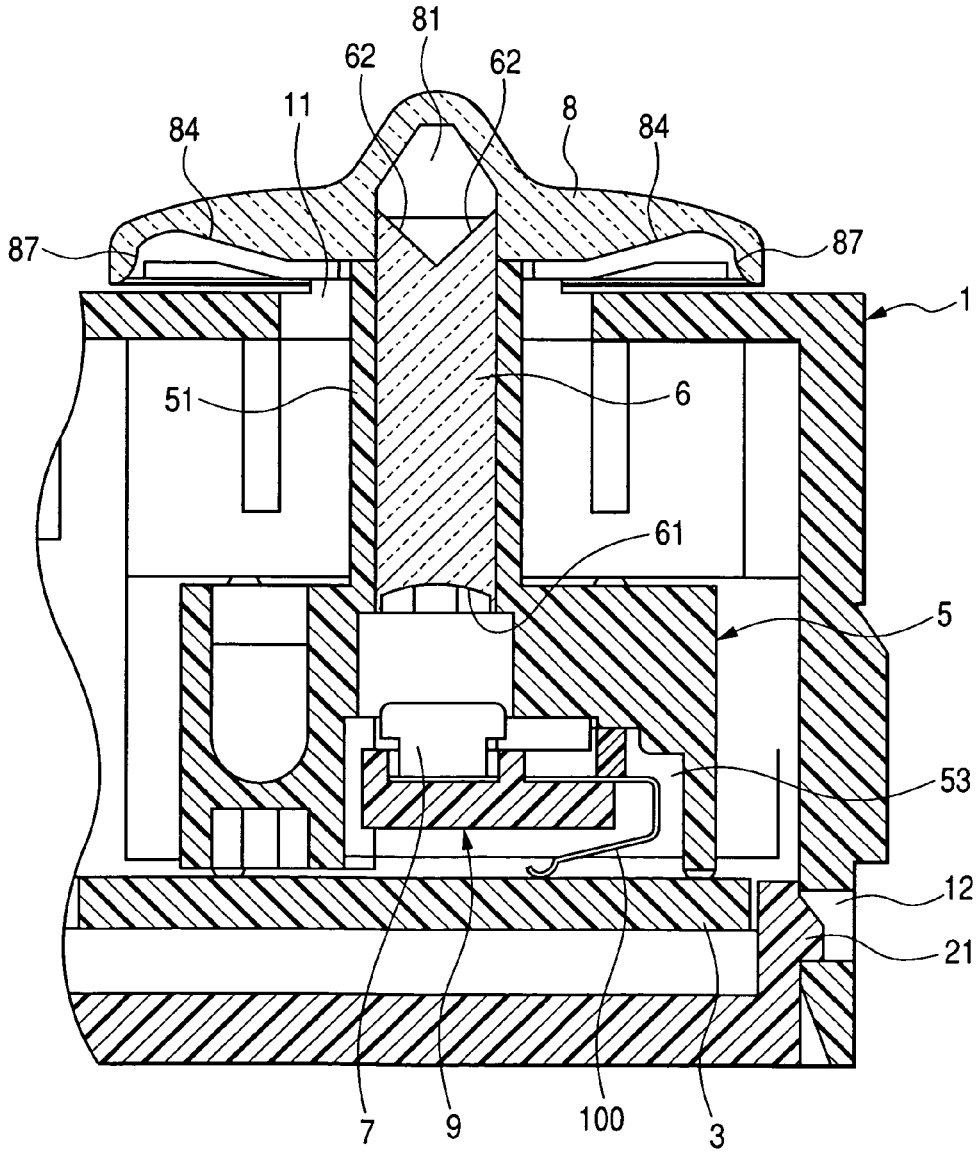
FIG. 2 is a cross-sectional view taken along a line 2-2 in FIG. 1.
Figure 3:
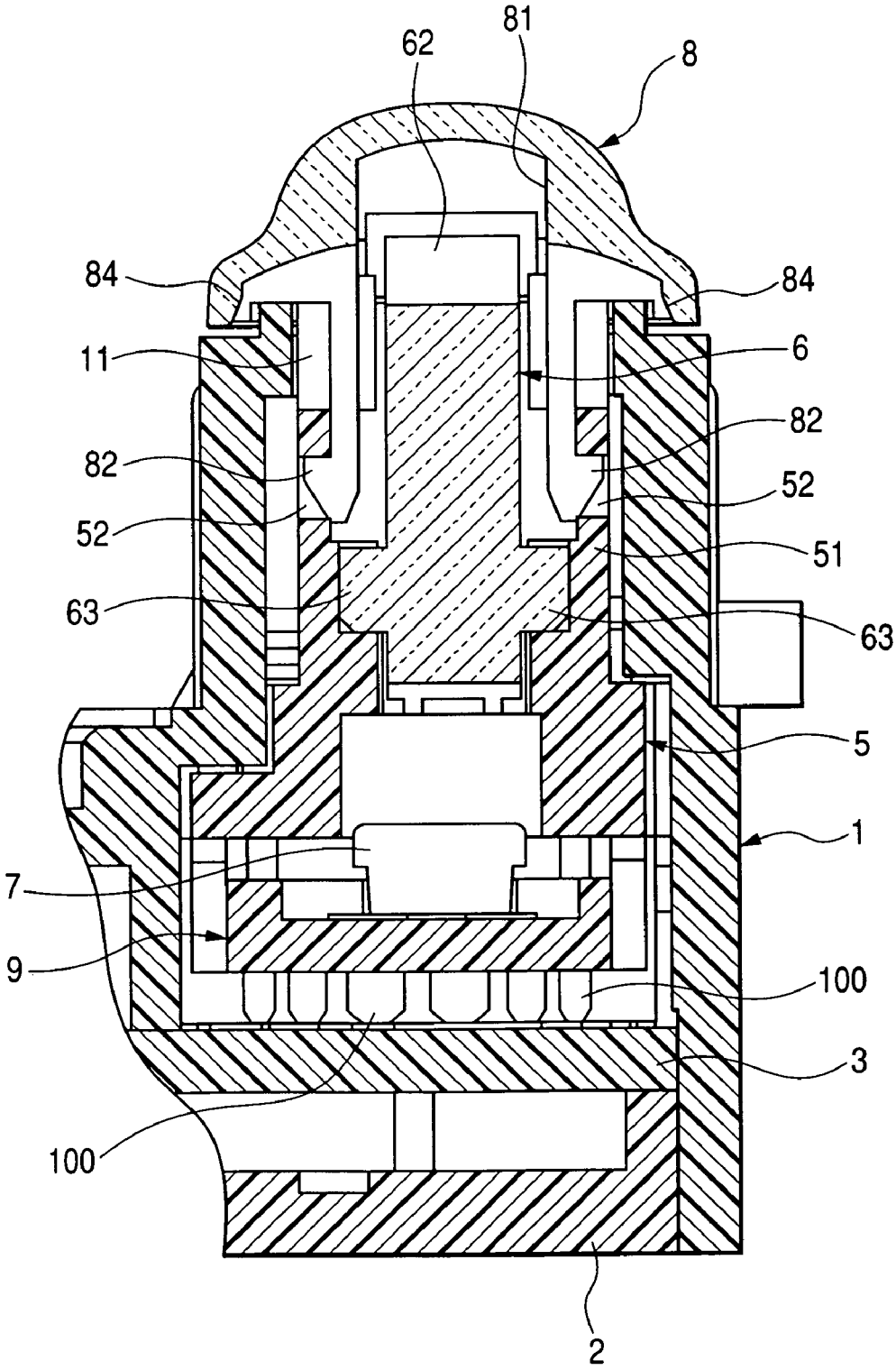
FIG. 3 is a cross-sectional view taken along a line 3-3 in FIG. 1.
Figure 4:
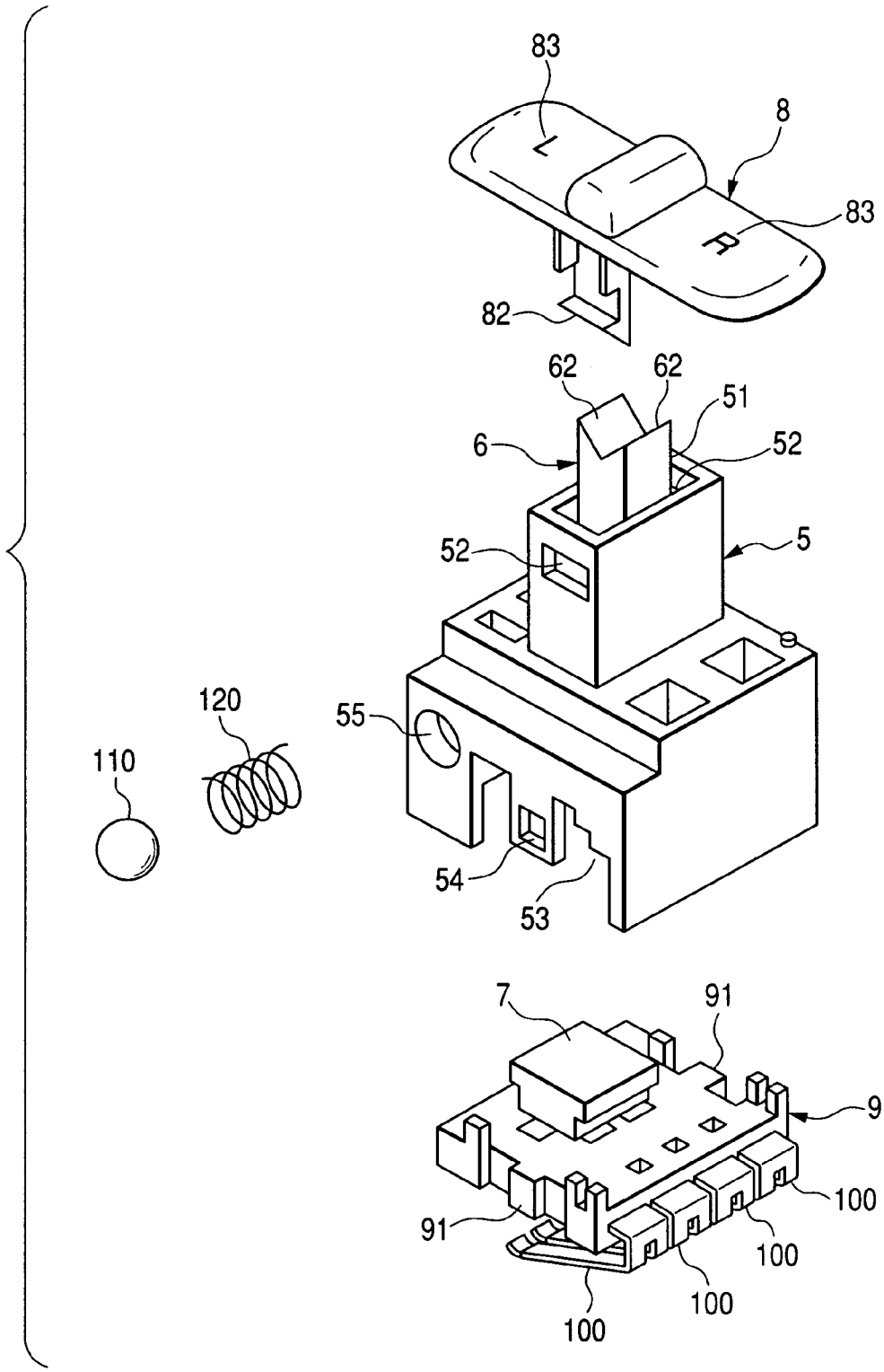
FIG. 4 is an exploded perspective view showing the lighted switch apparatus shown in FIG. 1.

An embodiment of the invention will be described with reference to the drawings. FIG. 1 is a plan view showing a lighted switch apparatus according to an embodiment of the invention, FIG. 2 is a cross-sectional view taken along a line 2-2 in FIG. 1, FIG. 3 is a cross-sectional view taken along a line 3-3 in FIG. 1, FIG. 4 is an exploded perspective view showing a change-over switch of the lighted switch apparatus shown in FIG. 1, FIG. 5 is a view illustrating a light leakage at an end portion of an operating knob, and FIG. 6 is a cross-sectional view showing a light path of the operating knob.

In FIGS. 1 to 6, a reference numeral 1 indicates an upper case (corresponding to a part of the casing) of cases. The upper case 1 is made of, for example, synthetic resin, and has a hollow shape with an opened bottom. A square transparent hole (not shown) is provided roughly in the center of an upper surface of the upper case 1. A guide portion (not shown) for guiding an actuator (not shown) in the four-directions is provided on the inner circumferential surface of the transparent hole. In addition, a rectangular opening 11 is provided at one end of the upper portion of the upper case 1, and rectangular engaging holes 12 are provided at the bottom of two side-walls, which face each other, of the upper case 1, respectively.

Reference numeral 2 indicates a lower case (corresponding to a part of the casing) of cases. The lower case 2 is made of, for example, synthetic resin, and the lower case 2 has a shape that is slightly smaller than the opened bottom of the upper case 1 and has a concave shaped upper surface. Rectangular engaging protrusions 21 integrally protrudes from two side-walls, which face each other, of the lower case 2, respectively, so as to correspond to the rectangular engaging holes 12 of the upper case 1. The lower case 2 is intruded into the opened bottom of the upper case 1 and the rectangular engaging protrusions 21 of the lower case 2 are engaged with the engaging holes 12 of the upper case 1 so that the upper case 1 and the lower case 2 are integrally assembled to each other.

A circuit board 3 is disposed on the upper portion of the lower case 2. The circuit board 3 consists of, for example, the laminated circuit boards made of phenol resin. Left and right changeover patterns and a power-feeding pattern are provided on the upper surface of the circuit board 3 by a printing method. The left and right changeover patterns output signals corresponding to positions of L and R indicators 83 of an operating part 8, which is made of a conductor, to be described below, and are disposed with a predetermined space therebetween in the sliding direction. Movable contacts for blinking LED to be described below, that is, sliding elements 100 slide on the power-feeding pattern over the whole area on which the operating part 8 to be described below moves. The circuit board 3 is intruded into the lower case 2 to be fixed thereto.

Reference numeral 4 indicates a switching knob of a four-direction switch. The four-direction switching knob 4 is fitted to an upper end of a shaft of the actuator to be fixed thereto. The four-direction switching knob 4 is made of, for example, optical transparent synthetic resin (acryl resin (PMMA: polymethylmethacrylate)), and has a circular shape. Each of recessed marks 41 is provided at four positions in the four-directions in which the four-direction switching knob 4 can be switched. Accordingly, it is possible to adjust an angle and an inclined direction of a right or left mirror selected by the operating part 8 to be described below by pressing the vicinity of each mark 41. Moreover, in the center of the four-direction switching knob 4, an optical transparent mark 42 for indicating that the knob is an operating member for adjusting an angle of the mirror is formed by coating an opaque coating material on the portion of the outer surface of the four-direction switching knob 4 other than the marks 42. Then, the above-mentioned mark 42 is configured to be lucent by light from a light source (not shown) fixed to the case.

Reference numeral 5 indicates a slider of a two-direction switch. The two-direction slider 5 is made of synthetic resin (for example, acryl resin), and has a near block shape. A rectangular tube shaped supporting part 51 integrally protrudes from roughly the center of an upper surface of the two-direction slider 5 so as to be upward perpendicular to the upper surface of the two-direction slider 5. Engaging holes 52 to be engaged with engaging members 82 of a two-direction operating part 8 are provided on the upper walls, which face each other, of the supporting part 51. In addition, a light-guiding member 6 is intruded into the supporting part 51.

Furthermore, an accommodating portion 53 into which a base 9 is inserted to be supported therein is provided on the lower surface of the two-direction slider 5. The accommodating portion 53 is communicated with a through hole provided in the supporting part 51 so that light form a light source 7 mounted on the base 9 illuminates the indicators 83 of the operating part 8 through the light-guiding member 6 intruded into the supporting part 51. Moreover, engaging pieces 54 each having an engaging hole are provided on both sides of the accommodating portion 53 of the two-direction slider 5, respectively,. and the engaging pieces 54 are engaged with engaging protrusions 91 each protruding from both side of the base 9 so that the base 9 is fixed to the accommodating portion 53.

In addition, a circular accommodating portion 55 accommodating a ball 110 and a spring 120 as switching mechanism is formed on one side surface of the two-direction slider S along the sliding direction thereof.

The two-direction slider 5 is provided in the upper case 1 so as to be able to slide linearly between the upper case 1 and the upper surface of the circuit board 3. The supporting part 51 of the two-direction slider 5 protrudes outside of the upper case 1 through the rectangular opening 11 of the upper case 1.

Reference numeral 9 indicates a base. As shown in FIG. 4, the base 9 is connected and fixed to a circuit pattern (not shown) having the light source (LED) 7 mounted on the surface thereof. In addition, the sliding elements 100, which are the movable contacts for blinking the LED and the movable contacts for LR (left and right) switching, are integrally formed on one edge of the base 9 so as to protrude and to extend to the lower surface of the base 9. The lower ends of the sliding elements 100 slide on a switching pattern formed on the circuit board 3 by sliding operation of the two-direction slider 5.

The light-guiding member 6 (corresponding to a shaft portion that is a part of the operating knob) is made of optical transparent synthetic resin such as polycarbonate, which has, for example, heat resistance and is transparent and colorless. Further, the light-guiding member 6 is a shaft portion, which has a rectangular parallelepiped shape and is combined with the through hole provided in the supporting part 51, and a lower surface thereof. Furthermore, the lower surface 61 of the light-guiding member 6 is formed to have a semicircular cross-section and faces the light source (illuminating member) 7 so as to serve as an incident portion. Moreover, the upper end of the light-guiding member 6 is formed roughly in the concave V shape so as to serve as a pair of second reflecting portions 62, and is fitted to a recess 81 of the operating part 8. The light-guiding member 6 is configured so that light from the light source 7 is led from the lower surface 61 of the light-guiding member 6 to the second reflecting portions 62 and then is reflected at the second reflecting portions 62 to be led into the operating part 8. Reference numeral 63 indicates each of positioning protrusions that protrudes from the lower portion of the side surface of the shaft portion of the light-guiding member 6. When being intruded into insertion holes of the supporting part 51 of the two-direction slider 5, the positioning protrusions 63 abut against regulating steps formed in the insertion holes.

Reference numeral 8 indicates an operating part (knob light guiding part) of a two-direction switch. The two-direction operating part 8 is made of, for example, optical transparent synthetic resin such as polycarbonate. The two-direction operating part 8 is provided with a recess 81, engaging members 82, and L and R indicators 83. The recess 81 is provided in the center of the two-direction operating part 8 so that the upper end of the light-guiding member 6 is intruded thereinto. The engaging members 82 protrude downward from both edges of the recess 81 to be engaged with the engaging holes 52, which are formed on the upper portion of the supporting part 51 of the two-direction slider 5. The L and R indicators 83 are formed on the surface of the two-direction operating part 8, and is optical transparent. Furthermore, inclined reflecting surfaces 84 are provided on the lower surface of the portion, made of polycarbonate, of the two-direction operating part 8. Accordingly, light from the light source 7 is led into the two-direction operating part 8 by being branched at the second reflecting portions 62 of the light-guiding member 6 and then is reflected upward by the reflecting surfaces 84 to light the L and R indicators 83. Consequently, even though the operating part 8 is operated, the relative position between the lower surface 61 of the shaft portion of the light-guiding member 6 and the light source 7 is not changed. Therefore, it is possible to uniformly light the L and R indicators 83.

Although omitted in FIGS. 2 and 3, light-shielding portions 85 and 86 and the like are formed on the surface of the operating part 8 as shown in FIGS. 5 and 6. That is, each of the L and R indicators 83 is formed by forming the light-shielding portion 85. The light-shielding portion 85 is formed by coating a white coating material on the upper surface of the two-direction operating part 8, by masking the white coating material in the form of L and R, and then by coating an opaque coating material on the white coating material other than the L and R. Furthermore, after melted polycarbonate is filled in molds (not shown), a gap is formed by releasing a lower mold from an upper mold, and then a melted opaque synthetic resin, such as a white ABS (acrylonitrile butadiene styrene) resin, is filled in the gap, whereby the light-shielding portion 86 is formed on the lower surface of the two-direction operating part 8 by two-color molding.

Reference numerals 110 and 120 indicate a ball 110 and a spring 120 serving as switching mechanism, respectively. The spring 120 is accommodated in the accommodating portion 55, which is formed on one side surface of the two-direction slider 5, in the compressed state. Meanwhile, the ball 110 is provided between the compressed spring 120 and a switching groove (not shown) formed on the inner surface of the upper case 1. The switching groove is composed of a V-shaped trough (not shown) formed in the middle thereof, a first crest portion (not shown) and a second crest portion (not shown) formed on both sides of the V-shaped trough, and a first inclined surface (not shown) and a second inclined surface (not shown) extending from the first crest portion and the second crest portion. Meanwhile, the ball 110 is intruded into the switching groove by the spring 120. In the switching mechanism, when the ball 110 is positioned in the V-shaped trough, the two-direction slider 5 is positioned in a neutral position. Further, when the ball 110 is positioned on the first inclined surface, the two-direction slider 5 is positioned in a first position (for example, L position). Furthermore, when the ball 110 is positioned on the second inclined surface, the two-direction slider 5 is positioned in a second position (for example, R position). In the switching mechanism, the two-direction operating part 8 and the two-direction slider 5 are maintained to be positioned in the neutral position and the first and the second positions such that the moderation feeling is obtained from the switching of the two-direction operating part 8 and the two-direction slider 5.

The lighted switch apparatus according to this embodiment of the invention has the same structure as has been described, and the assembly of the main part thereof will be described below.

As shown in FIGS. 2 to 4, the base 9, which has the sliding elements 100 and the light source 7, is inserted into the accommodating portion 53 of the two-direction slider 5 so that the engaging protrusions 91 are intruded into the engaging pieces 54 to be fixed thereto. In addition, the light-guiding member 6 is inserted into the supporting part 51 of the slider 5 until the positioning protrusions 63 abut against the supporting part 51. Furthermore, the engaging members 82 are inserted into the gaps between the light-guiding member 6 and the inner wall of the supporting part 51, and then the engaging members 82 are engaged with the engaging holes 52, respectively so that the two-direction operating part 8 is fixed to the slider 5 at the upper end of the light-guiding member 6. In addition, the upper end of the light-guiding member 6 is fitted to the recess 81 of the operating part 8 so that the light reflected from the second reflecting portions 62 is led to reflecting surfaces 84 of the two-direction operating part 8.

Next, the operation thereof will be described.

First, during the operation of the two-direction switch, if the two-direction operating part 8 positioned in the neutral position shown in FIG. 2 is moved to the right or left side, the operation force for moving the two-direction operating part 8 is transmitted to the two-direction slider 5 such that the two-direction slider 5 also slides in the same direction as the operation force between the upper case 1 and the circuit board 3. In this case, when the two-direction slider 5 is positioned in the first position or the second position, the ball 110 positioned in the V-shaped trough overrides the first crest or the second the crest while descending once against the spring force of the spring 120, so as to be positioned on the first inclined surface or the second inclined surface. When the ball 110 overrides the crest and then falls to a trough, the moderation feeling is obtained. With the sliding of the two-direction slider 5, the sliding elements 100, which have the movable contacts for blinking LED and the movable contacts for LR switching, also slides on the circuit board in the same direction as the sliding of the two-direction slider 5. Then the sliding elements 100, which are the movable contacts for LR switching, are switched to the left or right switching pattern to be switched to a first circuit or a second circuit.

Next, if the two-direction operating part 8 positioned in the first position or the second position is moved to the neutral position, the two-direction slider 5 also slides from the first position or the second position to the neutral position. Accordingly, the ball 110 overrides the first crest or the second the crest from the first inclined surface or the second inclined surface so as to be positioned in the V-shaped trough. In this case, the sliding elements 100, which are the movable contacts for blinking LED and the movable contacts for LR switching, also slides in the same direction as the sliding of the two-direction slider 5 so as to be switched to a neutral state. In the neutral state, the sliding elements 100, which are the movable contacts for LR switching switched to the first circuit or the second circuit, come in contact with neither the left switching pattern nor the right switching pattern. Furthermore, the sliding elements 100, which are the movable contacts for blinking LED, slide on the power-feeding pattern of the circuit board 3 by the sliding operation thereof to always come in contact with the power-feeding pattern. For this reason, power is always fed to the light source 7 from the power-feeding pattern through the circuit pattern of the base 9 via contacts of the sliding elements 100, which are the movable contacts for blinking LED. Therefore, the L and R indicators 83 are lighted.

As described above, for example, in a state where the two-direction operating part 8 is switched to the left (L) side so that the two-direction switch forms the first circuit, when the four-direction switching knob 4 is tilted upward to form the first circuit, one surface of the left mirror is tilted upward. Further, when the four-direction switching knob 4 is tilted downward to form the second circuit, one surface of the left mirror is tilted downward. Furthermore, when the four-direction switching knob 4 is tilted to the left side to form the third circuit, one surface of the left mirror is tilted to the left side. Moreover, when the four-direction switching knob 4 is tilted to the right side to form the fourth circuit, one surface of the left mirror is tilted the right side. Next, in a state where the two-direction operating part 8 is switched to the right (R) side so that the two-direction switch forms the second circuit, when the four-direction switching knob 4 is tilted upward to form the first circuit, one surface of the right mirror is tilted upward. Further, when the four-direction switching knob 4 is tilted downward to form the second circuit, one surface of the right mirror is tilted downward. Furthermore, when the four-direction switching knob 4 is tilted to the left side to form the third circuit, one surface of the right mirror is tilted to the left side. Moreover, when the four-direction switching knob 4 is tilted to the right side to form the fourth circuit, one surface of the right mirror is tilted to the right side.

In addition, in a state in which the two-direction operating part 8 is switched to the neutral position, even though the four-direction switching knob 4 is tilted in any direction, the mirror is not moved. Accordingly, it is possible to prevent the mirrors from being operated by mistake.

If the two-direction slider 5 slides to the light source 7 accommodated in the two-direction slider 5, power is fed to the lighted switch apparatus according to the invention by the sliding elements 100, which are the movable contacts for blinking LED sliding on the circuit board 3, so as to be lighted. Accordingly, even though the two-direction slider 5 slides to any position, the light source 7 can emit light. The light from the light source 7 is incident from the lower surface 61 of the light-guiding member 6 facing the light source 7, and then is led to the outside, where the operating part 8 is positioned, through the light-guiding member 6 (shaft portion) via the opening 11. After that, the light is reflected and branched in the left and right directions at the second reflecting portions 62 to be led into the operating part 8. The light led into the operating part 8 is reflected upward at the reflecting surfaces 84 to light the indicators 83 of the two-direction operating part 8. As a result, since the indicators 83 of the two-direction operating part 8 are always shined stably and uniformly, there is no possibility to misunderstand a point to be switching-operated.

As described above, although the light led into the operating part 8 is reflected upward at the reflecting surfaces 84 to light the indicators 83, some of the light reflected upward at the reflecting surfaces 84 is reflected at the upper surface of the two-direction operating part 8 so as to reach end portions A (extension portions) thereof.

Figure 5A:
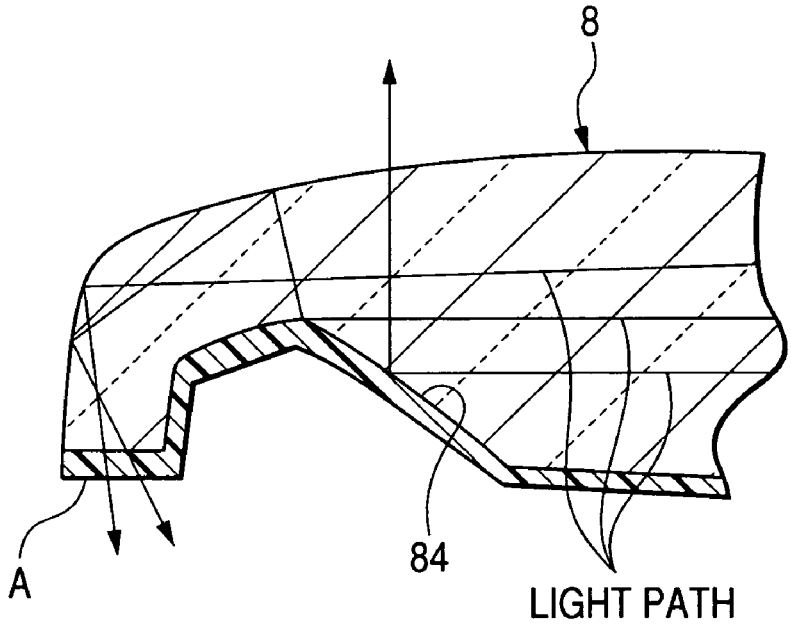
FIG. 5 is a view illustrating a light leakage at an end part of an operating knob.
Figure 6:
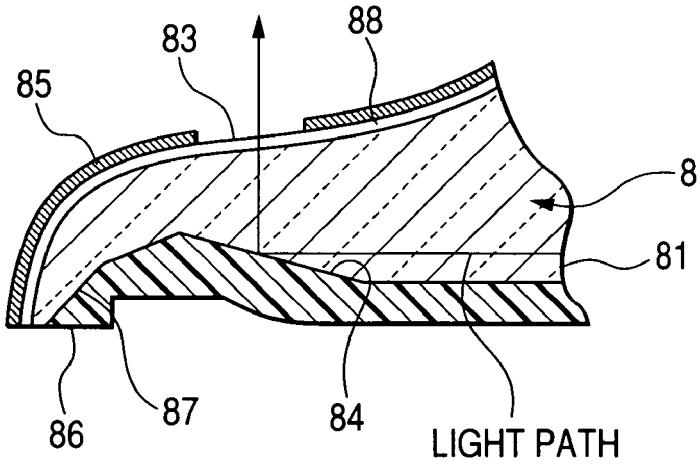
FIG. 6 is a cross-sectional view showing in detail a light-shielding portion and an indicator of the operating knob.
Figure 7:
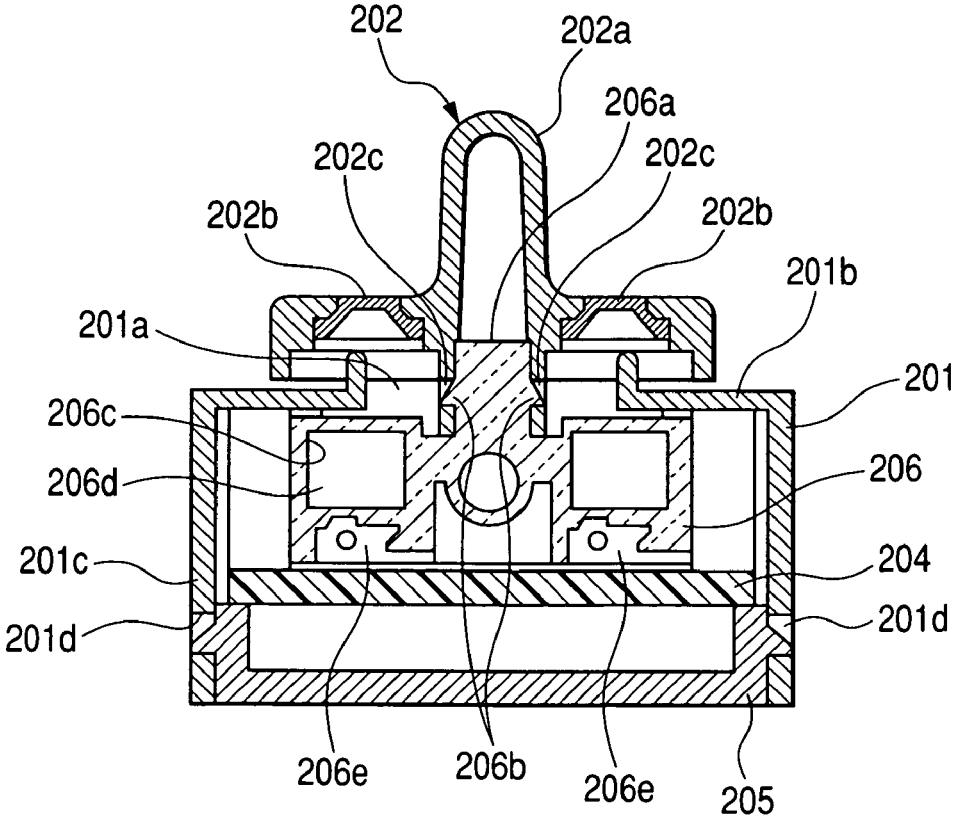
FIG. 7 PRIOR ART
FIG. 7 is a cross-sectional view showing a state in which an operating knob of a lighted switch apparatus according to the related art is in a neutral position.
Figure 8:
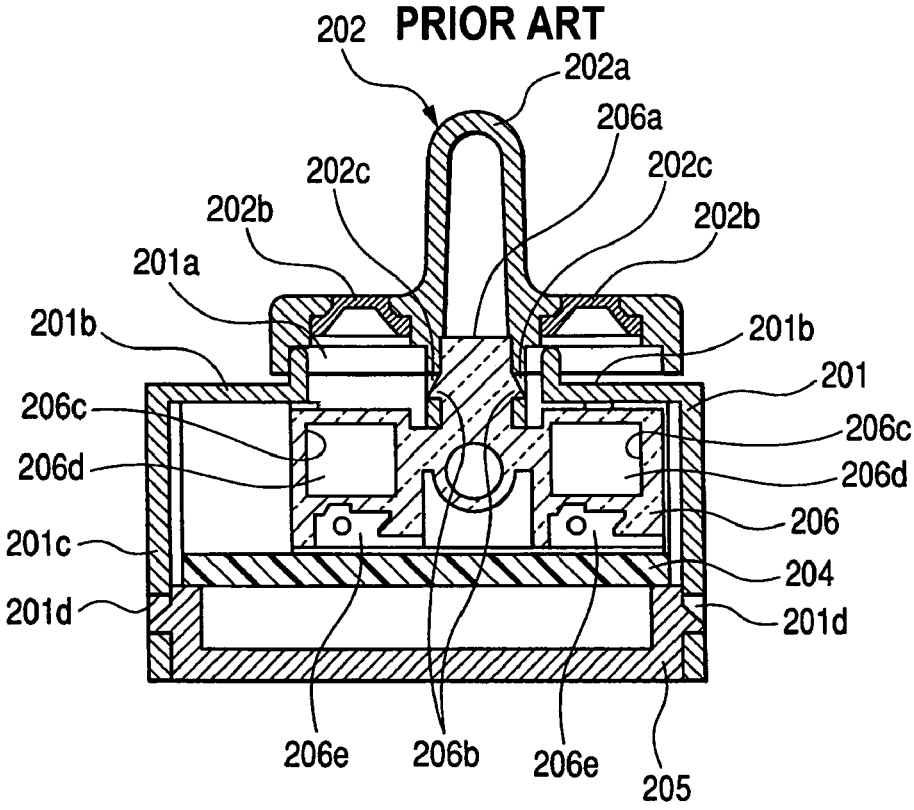
FIG. 8 PRIOR ART
FIG. 8 is a vertical cross-sectional view showing a state in which the operating knob of the lighted switch apparatus according to the related art is switched from the position shown in FIG. 7 to one direction.
Figure 9:
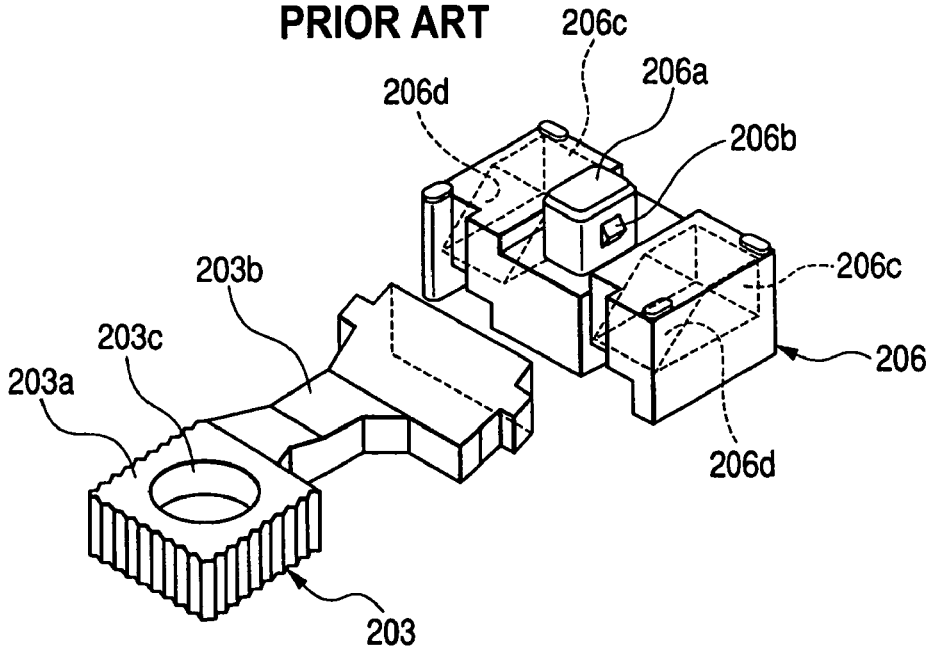
FIG. 9 PRIOR ART
FIG. 9 is a perspective view showing in detail a light-guiding member and a slider.

As shown in FIG. 5A, a portion between each of the reflecting surfaces 84 formed on the lower surface of the operating part 8 and each of the end portions A has a right angle shape, and a boundary formed by two-color molding faces outward. Further, since the boundary is easy to have steps and is formed by different processes, there is possibility that the boundary has different properties compared to a boundary formed by one process. In this case, even though the coating is performed on the surface of the boundary, there has been a problem that impressions caused by initial conditions or environmental changes are easily formed on the surface of the boundary. For this reason, it is conceivable that the light-shielding portion 86 is thinly formed to reduce the effect of the impressions. However, since a problem that melted resin is not sufficiently filled in the molds, that is, a problem so-called "short of resin" occurs, the light-shielding portion 86 is not securely formed.

Figure 5B:
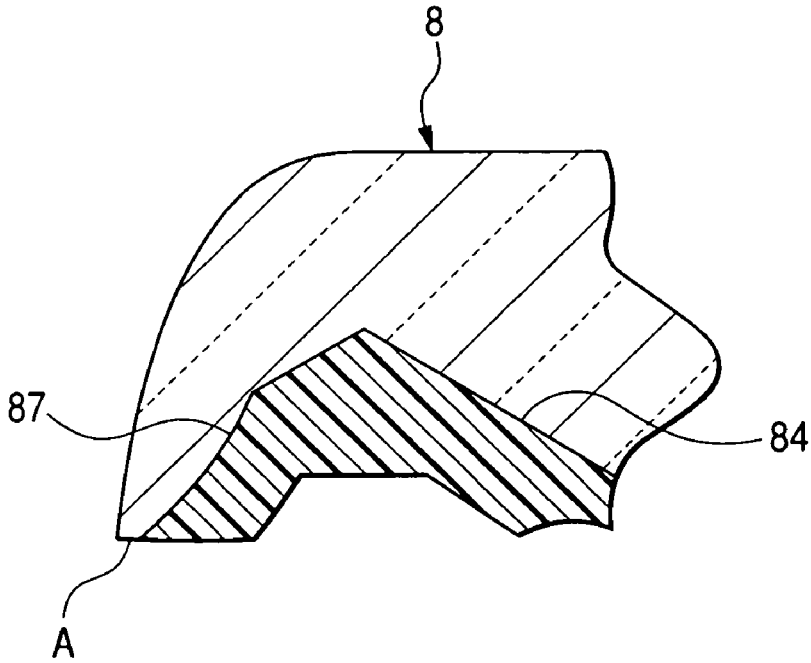

Consequently, in the present embodiment, as shown in FIG. 5B, a tapered portion 87 is formed on the portion between each of the reflecting surfaces 84 formed on the portion, made of polycarbonate, of the operating part 8 and each of the end portions A, and the light-shielding portion 86 is formed in an acute angle so as to be gradually thinner toward each of the end portions A.

For this reason, the boundary portion does not face outward, whereby the appearance problem does not occur. In addition, since some gap between the light-shielding portions 85 and 86 can be made small as possible, leakage of light does not become a problem.

Furthermore, in the present embodiment, although the second reflecting portions 62 are formed at the end of the shaft portion and the operating part 8 has a space formed by the recess 81 between the second reflecting portions 62, the operating part 8 may be formed in the shape to be fitted on the second reflecting portions. However, in this case, if the surfaces thereof are not completely coincided with each other, light is not reflected via a predetermined path. Accordingly, it is necessary to securely coincide with each other.

In addition, in the invention, the light-guiding member 6 and the portion, made of polycarbonate, of the operating part 8 are separately formed. However, they may be integrally formed as one member. In this case, it is necessary to form a space between the light-guiding member 6 and the portion, made of polycarbonate, of the operating part 8 in order to form the second reflecting portions according to the embodiment. Further, when it is difficult to form the space, said one member may be formed by so-called two-color molding. In the two-color molding, a first molding is performed to form a shape of the second reflecting portions, and then the portion with the shape is completely covered by a resin to form the shaft portion in a second molding.

Furthermore, in the embodiment, the operating part 8 is described as a two-direction sliding type. However, the invention is not limited thereto, and a four-direction (cross) sliding type or an all direction sliding type can be also applied to the operating part 8.

In the embodiment having the above-mentioned structure, the lighted switch apparatus includes a casing (a upper case 1) that has an opening 11; an operating part 8 that is movable and has at least a pair of indicators 83; and a light source 7 that is disposed in the casing (the upper case 1 and a lower case 2). In this case, the operating knob includes a shaft portion (light-guiding member 6 which is formed from one end of the shaft portion to the bottom of the indicator) composed of a light-guiding member having one end, which is inserted into the opening 11 of the casing to be positioned in the casing and is disposed to face the light source 7, a knob light guiding part (operating part 8) having reflecting portions 84 that are provided below the indicators 83 of the operating part 8 and reflects light from the other end of the shaft portion positioned outside of the casing to the indicators, and second reflecting portions 62 that reflect and lead the light from the other end of the shaft portion to the knob light guiding part. Accordingly, unlike the related art, after light is dispersed in the casing, the light is not led to the indicators through the opening, and a light from the light source 7 provided in the casing is dispersed by the second reflecting portions 62 disposed outside of the casing through the shaft portion of the light-guiding member 6, and then is led to the indicator 83. For this reason, the opening 11 of the casing may be formed in the moving range of the shaft portion (light-guiding part 6), and the opening 11 of the casing can be made small. Consequently, even though the operating part 8 is operated, the indicators 83 can be always illuminated and the opening 11 is small. Therefore, even though the operating part 8 is moved, the opening 11 is not obscure and possibility of penetration of the foreign material can be made little. In addition, it is possible to simply change the size of the indicators.

In the embodiment, the light source 7 is supported on the operating part 8 to be integrally moved. Accordingly, even though the operating part 8 is operated, the relative position between the lower surface of the shaft portion of the light-guiding member 6 and the light source 7 is not changed. Therefore, it is possible to uniformly light the indicators.

In the embodiment, the light-shielding portions 86 are formed on the operating part 8 by two-color molding. In case of coating work, the work itself is difficult compared to the two-color molding. In this sense, it is possible to easily manufacture the light-shielding portions.

Moreover, in the embodiment, the light-shielding portions 86 are formed on the lower surface of the operating part 8 (knob light guiding part), and each of the light-shielding portions 86 is provided with a tapered portion 87 and an extending portion (A), which is connected to the tapered portion 87 and extends in the direction away from the central portion. Accordingly, it is possible to prevent the light dispersed at the reflecting portions 84 or the light reflected from the indicators 83 from leaking to the outside of the operating knob.

Further, in the embodiment, the shaft portion of the light-guiding member 6 and the operating part 8 (knob light guiding part) are separately formed, and the second reflecting portions 62 are provided on the shaft portion of the light-guiding member 6. For this reason, the portion of the shaft portion forming the second reflecting portions 62 can be positioned in the recess 81 of the operating part 8 (knob light guiding part). Therefore, the structure thereof does not become complicated.

The invention claimed is:

1. A lighted switch apparatus comprising:

a casing having an upper surface with an opening formed therein, and a shielding portion formed around the opening;

an operating knob configured to permit light to pass therethrough that is slidingly movable and has at least a pair of indicators; and a light source that is disposed more inside the casing than the opening of the casing;

the operating knob further including:

a shaft portion composed of a light-guiding member configured to permit light to pass therethrough, the light-guiding member having one end configured to be receive within the opening of the casing and positioned in the casing, the one end configured to face the light source, a knob light guiding part having first reflecting portions that are provided below the indicators and configured to reflect light from another end of the shaft portion positioned outside of the casing to the indicators, wherein the one end of the shaft portion is positioned more inside the casing than the opening of the casing and the another end of the shaft portion is positioned more outside the casing than the opening of the casing, second reflecting portions that reflect and lead the light from the other end of the shaft portion to the knob light guiding part, wherein the knob light guiding part, the second reflecting portions, and the indicators are disposed more outside the casing than the opening of the casing; and wherein light emitted from the light source passes through the shaft portion and is directed to the knob light guiding part by the second reflecting portions, and then is directed to the indicators by the first reflecting portions of the light guiding part.

2. The lighted switch apparatus according to claim 1, wherein the light source is supported on the operating knob to be integrally moved.

3. The lighted switch apparatus according to claim 1, wherein the light-shielding portions are formed on the operating knob by two-color molding.

4. The lighted switch apparatus according to claim 3, wherein the light-shielding portions are formed on a surface of the knob light guiding part, and each of the light-shielding portions is provided with a tapered portion and an extending portion, which is connected to the tapered portion and extends in a direction away from a central portion.

5. The lighted switch apparatus according to claim 1, wherein the shaft portion of the light-guiding member and the knob light guiding part are separately formed, and the second reflecting portions are provided on the shaft portion.

* * * * *